US007141932B2

(12) United States Patent
Deguchi et al.

(10) Patent No.: US 7,141,932 B2
(45) Date of Patent: Nov. 28, 2006

(54) METAL HALIDE LAMP AND AUTOMOTIVE HEADLAMP APPARATUS

(75) Inventors: Makoto Deguchi, Ehime-ken (JP); Hiromichi Kawashima, Ehime-ken (JP); Kozo Uemura, Ehime-ken (JP); Hiroyuki Kato, Ehime-ken (JP); Nobuhiro Tamura, Kanagawa-ken (JP); Seiko Kawashima, Kanagawa-ken (JP)

(73) Assignees: Harison Toshiba Lighting Corp., Imabari (JP); Toshiba Lighting & Technology Corporation, Tokyo (JP)

( * ) Notice: Subject to any disclaimer, the term of this patent is extended or adjusted under 35 U.S.C. 154(b) by 0 days.

(21) Appl. No.: 10/394,017

(22) Filed: Mar. 24, 2003

(65) Prior Publication Data

US 2003/0222584 A1 Dec. 4, 2003

(30) Foreign Application Priority Data

Mar. 27, 2002 (JP) ..... 2002-089735

(51) Int. Cl.
*H01J 61/00* (2006.01)
*H01J 17/20* (2006.01)

(52) U.S. Cl. ..... 313/638; 313/25; 313/640; 313/643

(58) Field of Classification Search ..... 313/637, 313/638, 570, 643, 571, 640; 315/82
See application file for complete search history.

(56) References Cited

U.S. PATENT DOCUMENTS 5,854,535 A * 12/1998 Hohlfeld et al. ..... 313/636
5,936,350 A * 8/1999 Yoshida et al. ..... 313/631
6,265,827 B1 * 7/2001 Takahashi et al. ..... 313/638
6,307,321 B1 * 10/2001 Honda et al. ..... 313/634
6,353,289 B1 3/2002 Ishigami et al.
6,495,962 B1 * 12/2002 Uemura et al. ..... 315/77
6,608,444 B1 * 8/2003 Uemura et al. ..... 315/56
6,624,580 B1 * 9/2003 Kanegae et al. ..... 315/56
6,639,343 B1 * 10/2003 Takahashi et al. ..... 313/161
6,670,765 B1 * 12/2003 Muto ..... 315/82
6,724,145 B1 * 4/2004 Muto et al. ..... 313/638
6,861,807 B1 * 3/2005 Born et al. ..... 313/637
2002/0017848 A1 * 2/2002 Minamihata et al. ..... 313/161
2002/0027421 A1 * 3/2002 Kaneko et al. ..... 313/637
2003/0020408 A1 * 1/2003 Higashi et al. ..... 313/637
2003/0052610 A1 * 3/2003 Takagaki et al. ..... 313/637
2003/0062839 A1 * 4/2003 Takagaki et al. ..... 313/634
2003/0189408 A1 * 10/2003 Lapatovich et al. ..... 313/637

FOREIGN PATENT DOCUMENTS

EP 1 032 010 A1 8/2000
EP 1 063 681 A2 12/2000
EP 1 150 337 A1 10/2001
EP 1 172 840 A2 1/2002
WO WO00/05746 A1 * 2/2000

* cited by examiner

*Primary Examiner*—Ashok Patel
(74) *Attorney, Agent, or Firm*—Finnegan, Henderson, Farabow, Garrett & Dunner, L.L.P.

(57) ABSTRACT

A metal halide lamp includes a fire-resistant and translucent hermetic vessel containing amounts of scandium halide and sodium halide sealed in the hermetic vessel satisfying the formula of $0.25<a/(a+b)<0.5$, where reference character "a" denotes the mass of scandium halide and reference character "b" denotes the mass of sodium halide.

11 Claims, 10 Drawing Sheets

METAL HALIDE LAMP AND AUTOMOTIVE HEADLAMP APPARATUS

BACKGROUND OF THE INVENTION

1. Field of the Invention

The present invention relates to a metal halide lamp and an automotive headlamp apparatus incorporating the same.

2. Description of the Related Art

U.S. Pat. No. 6,353,289 by Ishigami discloses a metal halide lamp suitable for an automotive headlamp that substantially contains no mercury (conveniently referred to as a mercury-free lamp, hereinafter). The inventor of this invention is one of the inventors of the present invention. The metal halide lamp has electrodes distant from each other by 5 mm or less and has, sealed in a hermetic vessel as a discharge medium, first and second halides and a xenon gas at 5 atmospheres or higher at 25° C. The first halide is a halide of a light-emitting metal, and the second halide is a halide of a metal for providing a lamp voltage. As the second halide, a halide of a metal that has a high vapor pressure and emits no or a relatively little visible light is used, besides a halide of a light emitting metal. If the mercury-free lamp described above is a small metal halide lamp used in an automotive headlamp, it is turned on with a lamp power of 60 W or lower. Still, the mercury-free lamp in a stable state is as luminous as mercury-containing lamps.

However, if the first and second halides are sealed in the mercury-free lamp in an inappropriate ratio, there arise problems of high color deviation, low lamp voltage and low luminous efficiency. The reason for this is as follows: in many cases, the second metal halide sealed in place of mercury for providing a lamp voltage is low in luminous efficiency and emits visible light which is low in chromaticity, and therefore, the second metal halide causes the luminous efficiency of the lamp to be reduced or the chromaticity thereof to be degraded or provides an insufficient lamp voltage depending on the amount thereof.

As described above, the lamp voltage depends on the amount of the second halide sealed. A larger amount of the second halide sealed can provide a higher lamp voltage. However, the quantity of visible light is reduced and the luminous efficiency of the lamp is reduced. On the other hand, a smaller amount of the second halide increases the luminous efficiency of the lamp. However, the lamp voltage tends to decrease. Furthermore, when the lamp power supplied to the metal halide lamp is fixed, a higher lamp voltage and a lower lamp current result in a low current capacity of a lighting circuit, and thus, can provide a relatively inexpensive lighting circuit.

In addition, the mercury-free lamp is inferior in rising of luminous flux, in general. In the case of an automotive headlamp, the xenon gas emits light just as with mercury immediately after activation. However, after that, evaporation of the halides is insufficient until the temperature thereof is increased to 400 to 600° C., which takes about 4 seconds after the activation. Thus, during this period, the xenon gas keeps emitting light. Accordingly, a lamp power more than twice as high as that in a stable state need be supplied to the lamp for about 4 seconds, and thus, a maximum lamp current need be supplied to the lamp for about 4 seconds after the activation. Nevertheless, if the first and second halides are sealed in an inappropriate ratio, the rising of luminous flux is delayed, and 80% or more of the total luminous flux cannot be attained within 4 seconds after the activation.

To the contrary, in the case of a conventional metal halide lamp which contains mercury as a medium for providing a lamp voltage (conveniently referred to as a mercury-containing lamp, hereinafter), the xenon gas first emits light immediately after activation, and then, mercury evaporates to emit light immediately and rapidly. Since the luminous efficiency of mercury is several times as high as that of xenon, the rising of luminous flux is relatively fast, and 80% of the rated luminous flux is attained 4 seconds after the activation. This luminous flux can be attained by supplying a power about twice as high as the rated lamp power immediately after the activation. The maximum lamp current flows only during a period immediately after the activation, decreases rapidly after a lapse of 1 to 2 seconds and becomes equal to or less than a half of the maximum after a lapse of 4 seconds.

However, the present inventors have found that, also in the mercury-free lamp, appropriate rising of luminous flux can be provided if the ratio between the first and second halides sealed is appropriately determined.

Furthermore, the mercury-free lamp cannot attain the same level of total luminous flux in a stable state as the mercury-containing lamp if the ratio between the sealed first and second halides is in appropriate. On the other hand, the mercury-containing lamp can easily attain a desired level of total luminous flux because the mercury vapor produces visible light by discharge, which largely contributes to the total luminous flux.

SUMMARY OF THE INVENTION

An object of the invention is to improve the ratio between first and second halides sealed in a mercury-free lamp to enhance the luminous efficiency thereof, thereby providing a metal halide lamp which has a low lamp voltage reduction, emits light of an appropriate color and is suitable for an automotive headlamp and an automotive headlamp apparatus incorporating the same.

Another object of the invention is to provide a metal halide lamp with a rapid rising of the luminous flux suitable for an automotive headlamp and an automotive headlamp apparatus incorporating the same.

Another object of the invention is to provide a metal halide lamp with an increased total luminous flux suitable for an automotive headlamp and an automotive headlamp apparatus incorporating the same.

Another object of the invention is to provide a metal halide lamp with a chromaticity suitable for an automotive headlamp and an automotive headlamp apparatus incorporating the same.

According to the invention, in order to attain the objects described above, the first halides, which contain a halide of a light-emitting metal, mainly contain scandium halide and sodium halide, and the amounts of scandium halide and sodium halide satisfies the formula:

$$0.25<a/(a+b)<0.8,$$

where reference character a denotes the mass of scandium halide sealed and reference character b denotes the mass of sodium halide sealed.

The lower limit in the above formula is determined for the following reason. That is, if the ratio a/(a+b) is lower than the lower limit, the lamp voltage is too low. Thus, in order to supply a required lamp power to the lamp, the lamp current needs to be increased, and thus, a practical problem with a lighting device arises. In addition, the luminous efficiency is reduced, and thus, the total luminous flux is excessively reduced. On the other hand, the upper limit in the above formula is applied to a case where the first halides contain a halide of indium, for example, in addition to scandium halide and sodium halide. And, the upper limit is determined for the following reason. That is, if the ratio a/(a+b) is higher than the value, the luminous efficiency is reduced again, although the lamp voltage can be increased. In addition, the resulting chrominance is far above a value specified for the metal halide lamp for an automotive headlamp. Here, in addition to the primary light-emitting substances containing scandium and sodium, a halide of a light-emitting metal other than the primary light-emitting substances, such as indium, that is, a halide of an auxiliary light-emitting metal can be sealed in the form of iodide or bromide in a relatively small amount. This facilitates adjustment of the chromaticity of the light emitted by the metal halide lamp.

Suitable halogens as the first and second halides are as follows. In terms of reactivity, iodine is most suitable. At least the primary light-emitting metal described above is sealed in the hermetic vessel in the form of an iodide. However, essentially, different compounds of halogen, for example iodide and bromide, may be used together.

Thus, the invention can provide a metal halide lamp which has a high luminous efficiency and a low lamp voltage reduction, emits light of an appropriate color and is suitable for an automotive headlamp. However, preferably, the ratio a/(a+b) falls within the following range, and in this case, more advantages are provided.

$$0.27<a/(a+b)<0.37$$

In the metal halide lamp according to a preferred first embodiment of the invention, the discharge medium contains metal halides including at least $ScI_3$, NaI and InBr and/or InI, and the mass ratio of the halides to the sum of scandium halide and sodium halide is one-fifth or less.

Thus, according to this embodiment, the chromaticity of the light emitted by the metal halide lamp can be adjusted without undesired reduction in luminous efficiency, and a value thereof specified for the automotive headlamp can be more readily attained.

According to a preferred second embodiment, the amounts of scandium halide, sodium halide and the second halide sealed in the hermetic vessel satisfies the formula:

$$0.01<c/(a+b+c)<0.4,$$

where reference character a denotes the mass of scandium halide, reference character b denotes the mass of sodium halide and reference character c denotes the mass of the second halide.

The lower limit in the above formula is applied to a case where the first halides contain a halide of indium or the like in addition to scandium halide and sodium halide. As the ratio c/(a+b+c) decreases, the luminous efficiency gradually increases, the chrominance becomes larger and becomes out of a white range and out of specification, and the lamp voltage gradually decreases. If the decreasing ratio c/(a+b+c) finally becomes lower than the lower limit, the lamp voltage is too low, and a practical problem arises that the lighting device is difficult to design. On the other hand, as the ratio c/(a+b+c) increases, the lamp voltage increases and the chrominance becomes smaller, while the luminous efficiency decreases. If the ratio c/(a+b+c) is higher than the upper limit in the above formula, the luminous efficiency is excessively reduced. However, if the above formula is satisfied, the following advantages can be provided. Here, if the first halides contain no auxiliary halide of a light-emitting metal, such as indium, that is, the first halides contain only halides of primary light-emitting metals, the lower limit in the above formula is appropriately set to 0.1. In this case, if the ratio c/(a+b+c) is lower than 0.1, the disadvantages described above occurs. Thus such a situation should be avoided.

Most preferably, the ratio c/(a+b+c) satisfies the following formula, and in this case, more advantages are provided.

$$0.22<c/(a+b+c)<0.33$$

In this embodiment, the second halide is a medium for providing a lamp voltage in place of mercury, and contributes to adjustment of chromaticity depending on which is selected among from the following group of metals. That is, the second halide is a halide of a metal which has a high vapor pressure and emits no or a relatively little visible light, that is, a halide of a metal which is not a promising light-emitting metal for providing a significant luminous flux but is suitable for providing a lamp voltage. The second halide may be the halide(s) of one or more metals selected among from the group of Mg, Co, Cr, Zn, Mn, Sb, Re, Ga, Sn, Fe, Al, Ti, Zr and Hf.

Among the metals in the group described above, zinc is quite preferable because the vapor pressure of zinc halide is sufficiently high, and zinc halide has an ability of adjusting chromaticity, places a little load on the environment, is easy to handle and is available readily and at a low cost on an industrial scale.

According to this embodiment, the amount of the second halide sealed can be reduced to fall within an appropriate range. As a result, the luminous efficiency of the lamp can be increased, the total luminous flux can be kept at a high value, the lamp voltage can be maintained at or above a desired value, the increase of the lamp current can be suppressed to facilitate design of the lighting circuit, and the chrominance can be kept falling within an allowable range, whereby a metal halide lamp that emits light with an appropriate color can be provided. Furthermore, since the second halide is used, a lamp voltage of about 25 to 70 V can be provided without mercury. Thus, a desired lamp power can be supplied to the lamp with a relatively low lamp current.

According to a preferred third embodiment, the discharge medium contains the first and second halides in an amount of 0.005 $mg/mm^3$ or more of an inner volume of the hermetic vessel.

According to this embodiment, the total amount of all the halides sealed in the hermetic vessel, that is, the first and second halides, is increased, whereby the rising of the luminous flux is fastened while maintaining a desired total luminous flux. Specifically, if the mass ratio a/(a+b) concerning scandium halide a and sodium halide b, which are halides of primary light-emitting metals, falls within a range determined according to the invention, and the first and second halides are sealed in an amount of 0.005 $mg/mm^3$ or more of an inner volume of the hermetic vessel, the rising of the luminous flux at the time when turning on the metal halide lamp in a cold state can be improved, and 80% of the total luminous flux can be attained within 4 seconds.

Thus, according to this embodiment, the metal halide lamp with an improved rising of the luminous flux can be provided. Therefore, the specifications for the metal halide lamp for the automotive headlamp can be met. Here, the amount of the halides sealed in the hermetic vessel described above is significantly large compared to that of the mercury-containing lamp. Therefore, characteristically, an excess of the halides, which have not been evaporated, is in the liquid phase and adhered to the inner wall of the hermetic vessel when the lamp is on.

In the metal halide lamp according to a preferred fourth embodiment of the invention, the discharge medium contains the first and second halides in an amount of A mg/mm$^3$ of an inner volume of the hermetic vessel, and the formula is satisfied:

$$0.005<A<0.03.$$

According to this embodiment, a preferred range of the amount of the halides sealed in the hermetic vessel is defined. That is, in the above formula, for the lower limit value, the description made with reference to the third embodiment holds true. On the other hand, if the amount of the halides increases, the vapor pressure thereof also increases. However, as the amount approaches the upper limit value, the amount of the halides in the liquid phase adhered to the inner surface of the hermetic vessel increases, and the total luminous flux tends to decrease. Then, the amount becomes higher than the upper limit value, the lamp voltage increases beyond a specified value thereof. If the above formula is satisfied, the intended objects are attained. Preferably, the amount A satisfies a relation of $0.005<A<0.02$, and in this case, a still higher total luminous flux can be provided.

Thus, according to this embodiment, a high total luminous flux can be provided.

According to a preferred fifth embodiment of the invention, the inner volume of the hermetic vessel is 0.01 cc or less. This embodiment is suitable for small metal halide lamps, such as a metal halide lamp for an automotive headlamp.

According to a preferred sixth embodiment of the invention, the paired electrodes are at a distance of 4.2 mm±0.6 mm. According to this embodiment, a distance between the electrodes which is suitable for a metal halide lamp for an automotive headlamp is provided.

According to a preferred seventh embodiment of the invention, the xenon gas in the discharge medium is at 5 to 20 atmospheres at 25° C. This embodiment defines a generally possible range of the pressure of the xenon gas sealed in the hermetic vessel. That is, if the pressure of the xenon gas sealed is higher than 20 atmospheres, the metal halide lamp is difficult to manufacture, and the inner pressure thereof when the lamp is on is too high.

The xenon gas serves as a starting gas and a buffer gas and serves also to dominantly emit light immediately after the starting. Furthermore, since the pressure of the sealed xenon gas is high, the lamp voltage of the metal halide lamp immediately after the starting is also high. Thus, a higher lamp power can be provided with respect to a same lamp current, and improved rising characteristics of the luminous flux can be provided. The good rising characteristics of the luminous flux, which are advantageous for any use of the lamp, are essential particularly in applications of automotive headlamp, liquid-crystal projector and the like.

According to a preferred eighth embodiment of the invention, the xenon gas in the discharge medium is at 8 to 16 atmospheres at 25° C. This embodiment defines a range of the pressure of the xenon gas sealed in the hermetic vessel which is suitable for a metal halide lamp for an automotive headlamp. That is, the pressure of the sealed xenon gas equal to or higher than 8 atmospheres allows the lamp voltage to be increased to a preferred value and good rising characteristics of the luminous flux to be provided. Furthermore, the pressure of the sealed xenon gas equal to or lower than 16 atmospheres allows the metal halide lamp to be readily manufactured and the pressure in the lamp when the lamp is on to be prevented from excessively increasing.

According to a preferred ninth embodiment of the invention, the lamp power is 35 W±3 W. This embodiment defines a range of the lamp power suitable for a metal halide lamp for an automotive headlamp.

According to a preferred tenth embodiment of the invention, a metal halide lamp comprises: a hermetic vessel which is fire resistant and translucent; a pair of electrodes sealed in the hermetic vessel with facing each other at a distant of 5 mm or less, and a discharge medium substantially containing no mercury, sealed in the hermetic vessel, and containing first halides mainly including scandium halide and sodium halide, a second halide for mainly providing a lamp voltage and a xenon gas at 5 atmospheres or higher at a temperature of 25° C., the amounts of scandium halide, sodium halide and the second halide sealed in the hermetic vessel satisfying the formula:

$$0.01<c/(a+b+c)<0.4,$$

where reference character a denotes the mass of scandium halide, reference character b denotes the mass of sodium halide and reference character c denotes the mass of the second halide, and in a stable state, the metal halide lamp is turned on with a lamp power of 60 W or lower.

According to this embodiment, due to the arrangement described above, the amount of the second halide sealed can be reduced to fall within an appropriate range, the luminous efficiency of the lamp can be increased to keep the total luminous flux at a high value, and the lamp voltage can be maintained at or above a desired value. Thus, the increase of the lamp current can be suppressed to facilitate design of the lighting device, and the chrominance can be kept falling within an allowable range to provide light with an appropriate color.

In the metal halide lamp according to a preferred eleventh embodiment of the invention, the amounts of scandium halide, sodium halide and the second halide sealed in the hermetic vessel satisfies the formula:

$$0.1<c/(a+b+c)<0.4,$$

where reference character a denotes the mass of scandium halide, reference character b denotes the mass of sodium halide and reference character c denotes the mass of the second halide.

This embodiment is applied to a case where the first halides contains halides of light-emitting metals substantially contain only scandium halide and sodium halide. According to this embodiment, the amount of the sealed second halide can be reduced to fall within an appropriate range.

In the metal halide lamp according to a preferred twelfth embodiment of the invention, in addition to the arrangement according to the tenth embodiment, the discharge medium contains metal halides including at least $ScI_3$, NaI and InBr and/or InI. According to this embodiment, the same advantages as in the first embodiment are provided.

In the metal halide lamp according to a preferred thirteenth embodiment of the invention, in addition to the arrangement according to the tenth embodiment, the discharge medium contains the first and second halides in an amount of A mg/mm$^3$ of an inner volume of the hermetic vessel, and the formula is satisfied:

$$0.005<A<0.03.$$

According to this embodiment, the same advantages as in the fourth embodiment are provided.

In the metal halide lamp according to a preferred fourteenth embodiment of the invention, in addition to the arrangement according to the tenth embodiment, the inner volume of the hermetic vessel is 0.01 cc or less. According to this embodiment, the same advantages as in the fifth embodiment are provided.

In the metal halide lamp according to the preferred fourteenth embodiment of the invention, in addition to the arrangement according to the tenth embodiment, the paired electrodes are at a distance of 4.2 mm±0.6 mm. According to this embodiment, the same advantages as in the sixth embodiment are provided.

In the metal halide lamp according to a preferred fifteenth embodiment of the invention, in addition to the arrangement according to the tenth embodiment, the xenon gas in the discharge medium is at 8 to 16 atmospheres at 25° C. According to this embodiment, the same advantages as in the eighth embodiment are provided.

In the metal halide lamp according to a preferred sixteenth embodiment of the invention, in addition to the arrangement according to the tenth embodiment, the lamp power is 35 W±3 W. According to this embodiment, the same advantages as in the ninth embodiment are provided.

In the present invention and the preferred embodiments described above, the following embodiments can be selectively adopted as required.

<Hermetic Vessel>

The hermetic vessel is fire resistant and translucent. The words "fire resistance" mean that the hermetic vessel can adequately withstand a normal operating temperature of the discharge lamp. Therefore, the hermetic vessel may be made of any material as far as it has a fire resistance and can allow the visible light in a desired wavelength range produced by the discharge to be transmitted to the outside. For example, the hermetic vessel may be made of a ceramic, such as quartz glass, translucent alumina and YAG, or a single crystal thereof. However, in the case of an automotive headlamp, a high light collecting efficiency is required, and thus, quartz glass, which has a high linear transmittance, is suitably used. As required, the inner surface of the hermetic vessel made of quartz glass may be coated with a transparent film having a halogen resistance or halide resistance, or may be modified.

The hermetic vessel has a discharge space formed therein. In the case of a small metal halide lamp, such as a metal halide lamp for an automotive headlamp, the discharge space preferably has an inner volume of 0.01 cc or less and substantially has a shape of an elongated cylinder with an inner diameter of 1.5 to 3.5 mm and a longitudinal length of 5 to 9 mm. Thus, the temperature of the hermetic vessel increases faster in the upper portion thereof.

Furthermore, a part of the hermetic vessel which surrounds the discharge space can have a relatively high thickness. That is, a part of the hermetic vessel around the middle of the distance between the electrodes can be thicker than the end parts thereof. This enhances heat transfer of the hermetic vessel, where by the temperature of the discharge medium adhered to the inner surface of the lower part and side part of the discharge space of the hermetic vessel increases faster. Thus, a rapid rising of the luminous flux is attained.

Furthermore, in order for electrodes described later to be sealed in the hermetic vessel, a pair of rod-shaped sealing parts may be provided integrally with the hermetic vessel at both the longitudinal ends of the discharge space formed in the hermetic vessel. The electrodes are each connected to an externally introduced line via a sealed metal foil by, preferably, a decompression sealing method. Thus, the electrodes can be supplied with power, and any chip is excluded from the part surrounding the discharge space, whereby the light distribution characteristics can be prevented from being disturbed by an exhaust chip part that otherwise would be provided.

<A Pair of Electrodes>

The pair of electrodes is sealed in the hermetic vessel with the electrodes facing each other at a distance of 5 mm or less in general. In the case of a small metal halide lamp, such as a metal halide lamp for an automotive headlamp, the distance is preferably 3.5 to 5 mm, and more preferably 4.2 mm±0.6 mm. Each of the electrodes has a rod-shaped shaft part having a diameter substantially uniform in the longitudinal direction. The diameter of the shaft part is preferably 0.3 mm or more, and the electrode is not widened from the shaft part to the tip. The tip has a planar end surface, or the tip which originates an arc has a curved surface. In the case where the electrode is not widened from the shaft part to the tip and the tip which originates an arc has a curved surface, the curved surface is substantially spherical. If the radius is one-half or less of the diameter of the shaft part, the part which originates an arc can be prevented from being accidentally displaced, and occurrence of a luminance flicker can be suppressed. Here, the words "tip of the electrode which originates an arc" mean a part of the electrode which is located at the tip of the electrode and originates an arc. It does not necessarily refer to whole of the geometrical configuration of the tip of the electrode. That is, it is essential only that the part of the electrode which is located at the tip of the electrode and originates an arc has a curved surface having a radius of one-half or less of the diameter of the shaft part of the electrode. Preferably, however, the curved surface of the tip of the electrode which originates an arc has a radius of 40% or more of one-half of the diameter of the shaft part.

The length of the electrode protruding into the hermetic vessel, as well as the diameter of the shaft, affects the temperature of the electrode. This can be the same as in common small metal halide lamps of this type. Thus, for example, it can be set to about 1.4±0.1 mm. Furthermore, the pair of electrodes may be adapted for an alternating current or direct current. If the lamp is operated by an alternating current, the electrodes of the pair have the same structure. If the lamp is operated by a direct current, in general, the temperature of the anode increases rapidly. Thus, the anode is allowed to have a shaft diameter larger than that of the cathode and thus a heat radiating area larger than that of the cathode, and can be ready for a frequent on/off operation.

The electrodes may be made of tungsten, doped tungsten, rhenium, a rhenium/tungsten alloy or the like. Furthermore, according to an arrangement for sealing the electrodes in the hermetic vessel, the electrodes may be supported by the base end parts thereof being embedded in the pair of sealing parts of the hermetic vessel. Here, the base end of the electrode is connected, by welding or the like, to the sealed metal foil made of molybdenum or the like that is hermetically embedded in the sealing part.

<Mercury>

The words "substantially contain no mercury" in the present invention mean that mercury is not sealed at all or that mercury may exist in an amount of less than 2 mg/cc of the inner volume of the hermetic vessel, preferably 1 mg/cc of the inner volume the hermetic vessel or less. However, it is desirable that no mercury is sealed from an environmental point of view. If the lamp voltage of the discharge lamp is to be increased to a desired level by the action of a mercury vapor as in the prior art, the mercury is sealed in the hermetic vessel in an amount of 20 to 40 mg/cm$^3$, possibly 50 mg/cm$^3$, of the inner volume of the hermetic vessel in the case of a short arc type metal halide lamp. Compared with this, the amount of mercury is significantly reduced.

<Lamp Power>

The lamp power is a power supplied to the metal halide lamp. According to the present invention, it is 60 w or less during a stable lighting-on time of the lamp. This means that the lamp is a small metal halide lamp. In the case of a metal halide lamp for an automotive headlamp, the lamp power is preferably 35 W±3 W.

<Other Components of the Invention>

The following components are not essential in the present invention. However, selectively adding any of these components to the metal halide lamp can enhance the performance and function thereof.

1 Outer Envelope

The outer envelope houses a discharge vessel therein. The outer envelope can block ultraviolet rays from being emitted from the discharge vessel to the outside, maintain the temperature of the discharge vessel or mechanically protect the discharge vessel. Furthermore, when a light-shielding film in a predetermined shape is used to provide desired light distribution characteristics, the light-shielding film may be formed on a surface of the outer envelope. As required, the outer envelope may be hermetically sealed from the outside air or may have air or an inert gas at an atmospheric or reduced pressure sealed therein. Furthermore, essentially, it may be communicated with the outside air.

2 Cap

The cap serves to connect the metal halide lamp to a lighting circuit or mechanically support the metal halide lamp on a lighting device.

3 Igniter

The igniter is to produce a high pulsed voltage and apply the voltage to the metal halide lamp to promote starting of the metal halide lamp. It may be housed in the cap to be incorporated into the metal halide lamp, for example.

4 Start Assistant Conductor

The start assistant conductor is to increase an electric field strength in the vicinity of the electrodes, thereby facilitating starting of the metal halide lamp. As required, one end of the start assistant conductor is connected to a part at the same potential as one electrode, and the other end thereof is disposed on a region of the outer surface of the discharge vessel in the vicinity of the other electrode.

An automotive headlamp apparatus according to the present invention comprises: an automotive headlamp apparatus main unit; a metal halide lamp described in claim 1 or 11 installed in the automotive headlamp apparatus main unit; and a lighting device for turning on the metal halide lamp.

Since the automotive headlamp apparatus according to the present invention has the metal halide lamp described in claim 1 or 11 as a light source, it has a high luminous efficiency and therefore can provide an enhanced total luminous flux. In addition, it can maintain a relatively high lamp voltage, emit light of an appropriate color and provide a rapid rising of the luminous flux. Furthermore, since mercury, which places a significant load on the environment, is not sealed in the metal halide lamp, the automotive headlamp apparatus of the present invention is extremely preferable from an environmental point of view. Here, the "automotive headlamp apparatus main unit" refers to the whole of the automotive headlamp apparatus except the metal halide lamp and the lighting device.

The lighting device turns on the metal halide lamp as desired. Preferably, it is electronized to be easily controlled and turns on the metal halide lamp in such a manner that a maximum power input within 4 seconds after the metal halide lamp is turned on is 2.5 to 4 times higher than the lamp power in a stable state. This can provide a rapid rising of the luminous flux within 4 seconds after the lamp is turned on and a luminous intensity of 8000 cd at a representative point of the front surface of the headlamp, which is required for the automotive headlamp.

Thus, according to the present invention, the automotive headlamp apparatus having the advantages described in claims 1 to 10 and 11 is provided.

DESCRIPTION OF THE PREFERRED EMBODIMENTS

Embodiments of the present invention will be described below with reference to the drawings.

Figure 1:
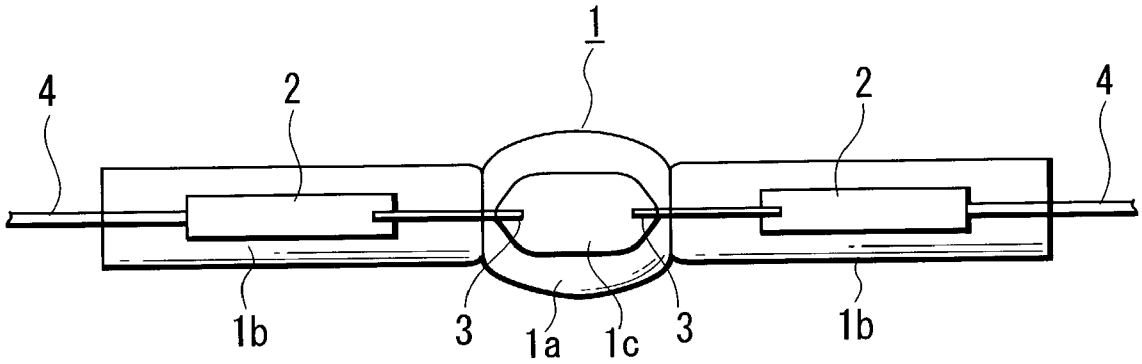
FIG. 1 is a front view of a metal halide lamp according to a first embodiment of the present invention.

FIG. 1 is a front view of a metal halide lamp according to a first embodiment of the present invention. In this drawing, reference numeral 1 denotes a hermetic vessel, reference numeral 2 denotes a sealed metal foil, reference numerals 3, 3 denote a pair of electrodes, and reference numeral 4 denotes an externally introduced line.

The hermetic vessel 1 comprises a surrounding part 1*a*, and a pair of sealing parts 1*b*, 1*b*. The surrounding part 1*a* is shaped into a spheroid, and the inside thereof is hollow and constitutes a longitudinally elongated cylindrical discharge space 1*c*. The pair of sealing parts 1*b*, 1*b* are formed at both ends of the surrounding part 1*a* integrally therewith and longitudinally extend from the ends of the surrounding part 1*a*.

The sealed metal foil 2 is a ribbon-shaped molybdenum foil. It is hermetically embedded in each of the sealing part 1*b*, 1*b* of the hermetic vessel 1 by a decompression sealing method.

Each of the paired electrodes 3, 3 has a rod-shaped shaft part 3*a*, and a tip 3*b* of the shaft part 3*a* of the electrode, which originates an arc, has a hemispherical curved surface having a radius of one-half or less of a diameter of the shaft part 3*a*. The electrodes are supported by respective base end parts 3*c* being embedded in the paired sealing parts 1*b*, 1*b* of the hermetic vessel 1 and protrude into the discharge space 1*c* from the both ends of the surrounding part 1*a* of the hermetic vessel 1 to face each other at a distant of 5 mm or less. A base end of each of the paired electrodes 3, 3 is connected to one end of the sealed metal foil 2.

The externally introduced line 4 has a tip welded to the other end of the sealed metal foil 2 and is led to the outside from the sealing part 1*b* of the hermetic vessel 1.

In the hermetic vessel 1*a*, halides of a light-emitting metal and a metal for mainly providing a lamp voltage and a xenon gas are sealed as a discharge medium.

EXAMPLE

The hermetic vessel 1 was made of quartz glass and had an outer diameter of 6 mm, an inner diameter of 2.7 mm and an inner volume of about 34 $mm^3$, and the surrounding part thereof was 7.0 mm long.

The electrode 3 was made of tungsten, the shaft part thereof had a diameter of 0.35 mm, the distance between the electrodes was 4.2 mm, and the length of protrusion of the electrode protruding into the discharge space was 1.4 mm.

The discharge medium contained metal halides including 0.1 mg of $ScI_3$, 0.2 mg of NaI and 0.1 mg of $ZnI_2$ in relations of $ScI_3/(ScI_3+NaI) \leqq 0.33$ and $ZnI_2/(ScI_3+NaI+ZnI_2)=0.25$, the metal halides being sealed in an amount of 0.012 mg per unit volume in the surrounding part, and a xenon gas at 10 atmospheres at a temperature of 25° C.

The electrical characteristics were as follows: the lamp power was 35 W and the lamp voltage was 46 V (both in a stable state).

The total luminous flux was 3100 lm (in a stable state).

Now, variations of the lamp voltage, total luminous flux and chrominance resulting when changing the ratio between sodium halide and scandium halide in this example will be described with reference to FIG. 2.

Figure 2:
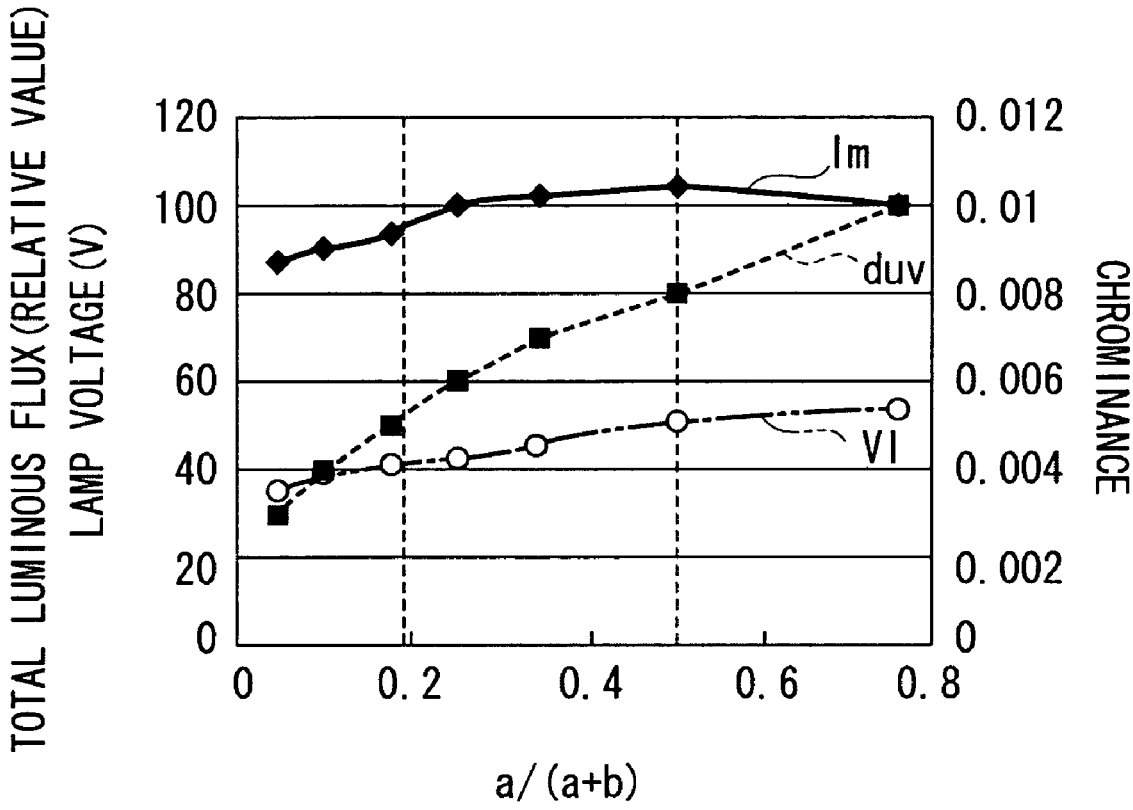
FIG. 2 is a graph showing relations between the ratio of scandium halide to the sum of scandium halide and sodium halide and the lamp voltage, total luminous flux and chrominance.

FIG. 2 is a graph showing relations between the ratio of scandium halide to the sum of scandium halide and sodium halide and the lamp voltage, total luminous flux and chrominance. In this drawing, the horizontal axis indicates the ratio a/(a+b), where the character a denotes the mass of scandium halide sealed and the character b denotes the mass of sodium halide sealed, the vertical axis at the left indicates the lamp voltage (V) and the total luminous flux (lm) and the vertical axis at the right indicates the chrominance. The curve Vl indicates the lamp voltage, the curve lm indicates the total luminous flux, and the curve duv indicates the chrominance.

It is proved that if a relation of $0.25<a/(a+b)<0.5$ according to the invention is satisfied, a high total luminous flux is attained, and the lamp voltage and the chrominance fall within an allowable range.

Now, an effect of the ratio of the second halide to the sum of the first and second halides on the relations between the ratio of scandium halide to the sum of scandium halide and sodium halide and the lamp voltage and total luminous flux in this example will be described with reference to FIG. 3.

Figure 3:
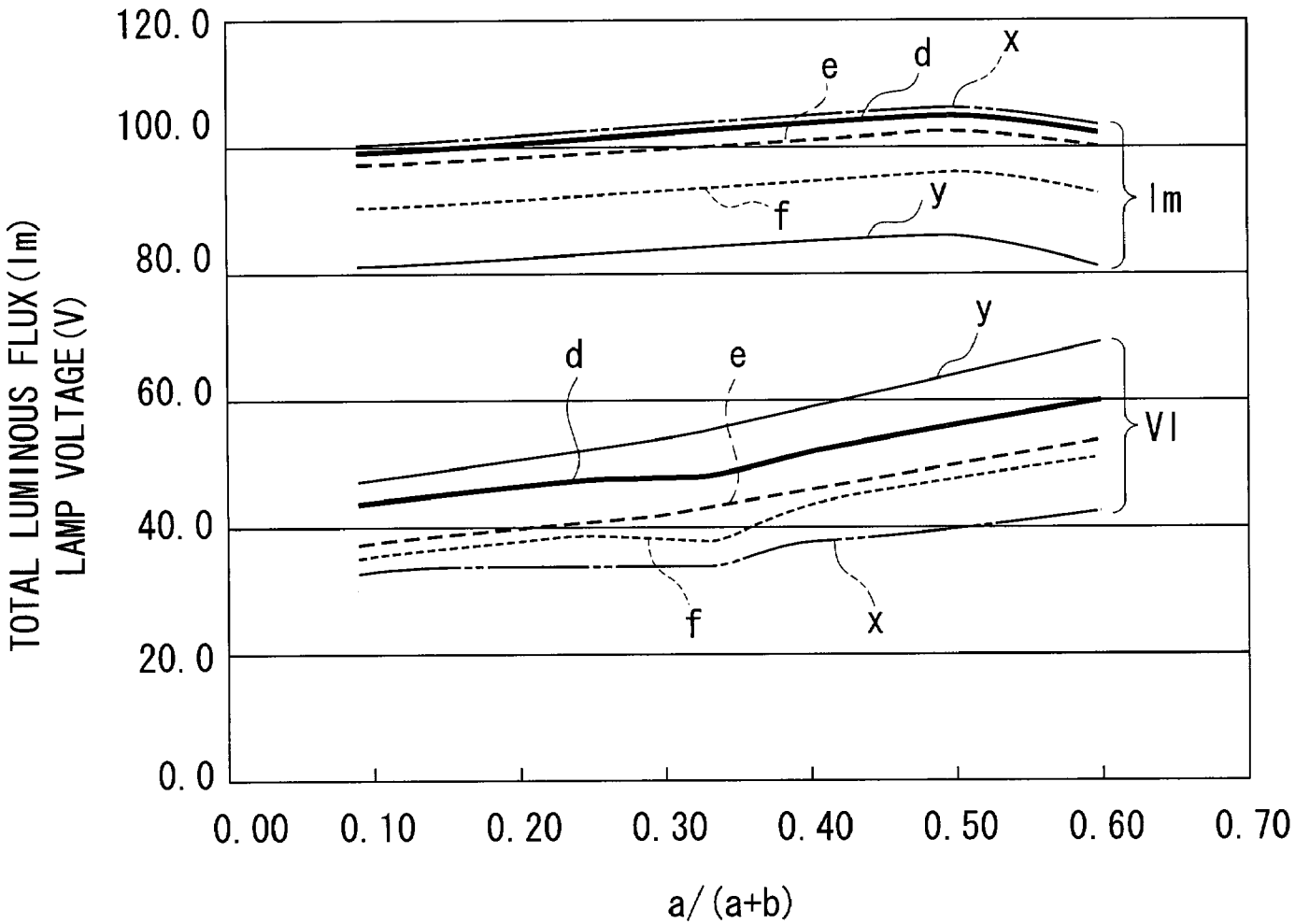
FIG. 3 is a graph showing relations between the ratio of scandium halide to the sum of scandium halide and sodium halide and the lamp voltage, total luminous flux and chrominance, where the amount of a sealed second halide in the amount of whole sealed halides is used as a parameter.

FIG. 3 is a graph showing relations between the ratio of scandium halide to the sum of scandium halide and sodium halide and the lamp voltage, total luminous flux and chrominance, where the amount of the sealed second halide in the amount of the whole sealed halides is used as a parameter. In this drawing, the same reference characters as in FIG. 2 have the same means as in FIG. 2. The group of curves Vl indicates the lamp voltage, and the group of curves lm indicates the total luminous flux. The plural curves in each group are different from each other in parameter c/(a+b+c). That is, c/(a+b+c)=0.1 for a curve d, c/(a+b+c)=0.25 for a curve e, c/(a+b+c)=0.4 for a curve f, c/(a+b+c)=0 for a curve x, and c/(a+b+c)=0.6 for a curve y. Where, a character c denotes the mass of zinc halide sealed.

As can be seen from this drawing, the lamp characteristics varying with a/(a+b) is not essentially affected by c/(a+b+c). However, the lamp voltage is higher for a larger amount c of the second halide sealed. And, the total luminous flux is lower for a smaller parameter c/(a+b+c).

Now, relations between the ratio of the second halide to the sum of the first and second halides and the lamp voltage, total luminous flux and chrominance in this example will be described with reference to FIG. 4.

Figure 4:
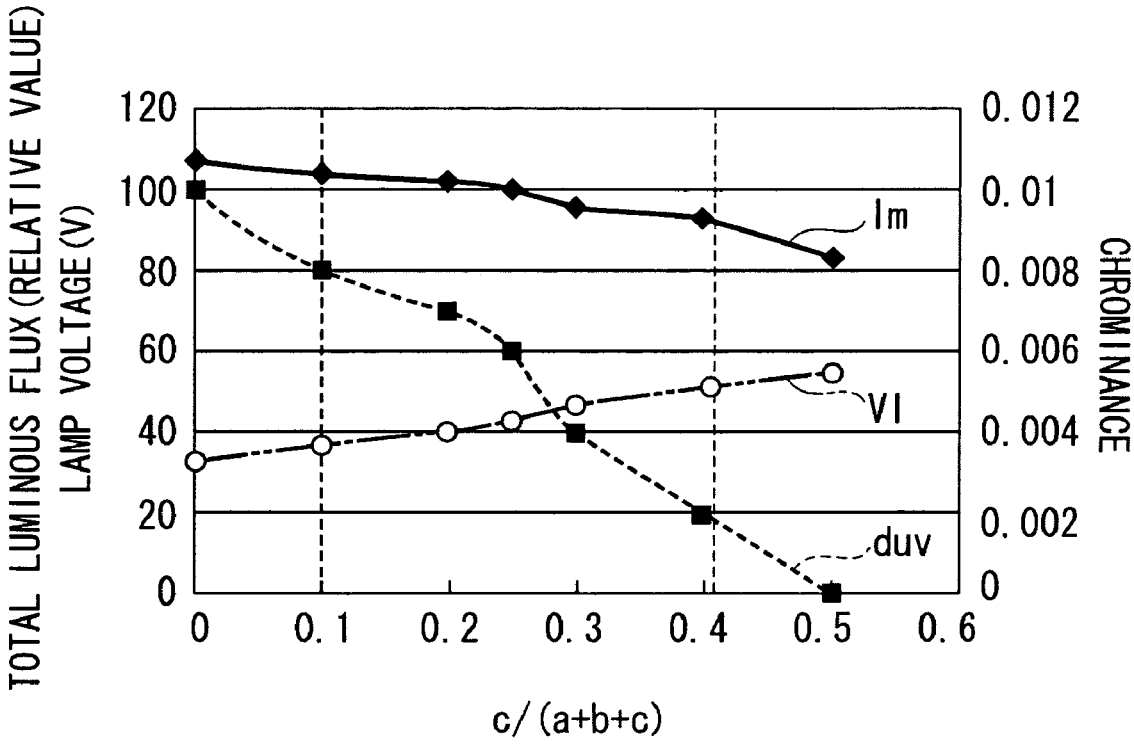
FIG. 4 is a graph showing relations between the ratio of the second halide to the sum of the first and second halides and the lamp voltage, total luminous flux and chrominance.

FIG. 4 is a graph showing relations between the ratio of the second halide to the sum of the first and second halides and the lamp voltage, total luminous flux and chrominance. In this drawing, the horizontal axis indicates the ratio c/(a+b+c), where the character a denotes the mass of scandium halide sealed, the character b denotes the mass of sodium halide sealed, and the character c denotes the mass of the second halide sealed. The vertical axis at the left indicates the lamp voltage (V) and the total luminous flux (lm), and the vertical axis at the right indicates the chrominance. The curve Vl indicates the lamp voltage, the curve lm indicates the total luminous flux, and the curve duv indicates the chrominance.

It is proved that if a relation of $0.1<c/(a+b+c)<0.4$ according to the invention is satisfied, a high total luminous flux and a high total luminous flux are attained, and the lamp voltage and the chrominance fall within an allowable range.

Furthermore, an effect of the ratio of scandium halide to the sum of scandium halide and sodium halide on the relations between the ratio of the second halide to the sum of the first and second halides and the lamp voltage and total luminous flux will be described with reference to FIG. 5.

Figure 5:
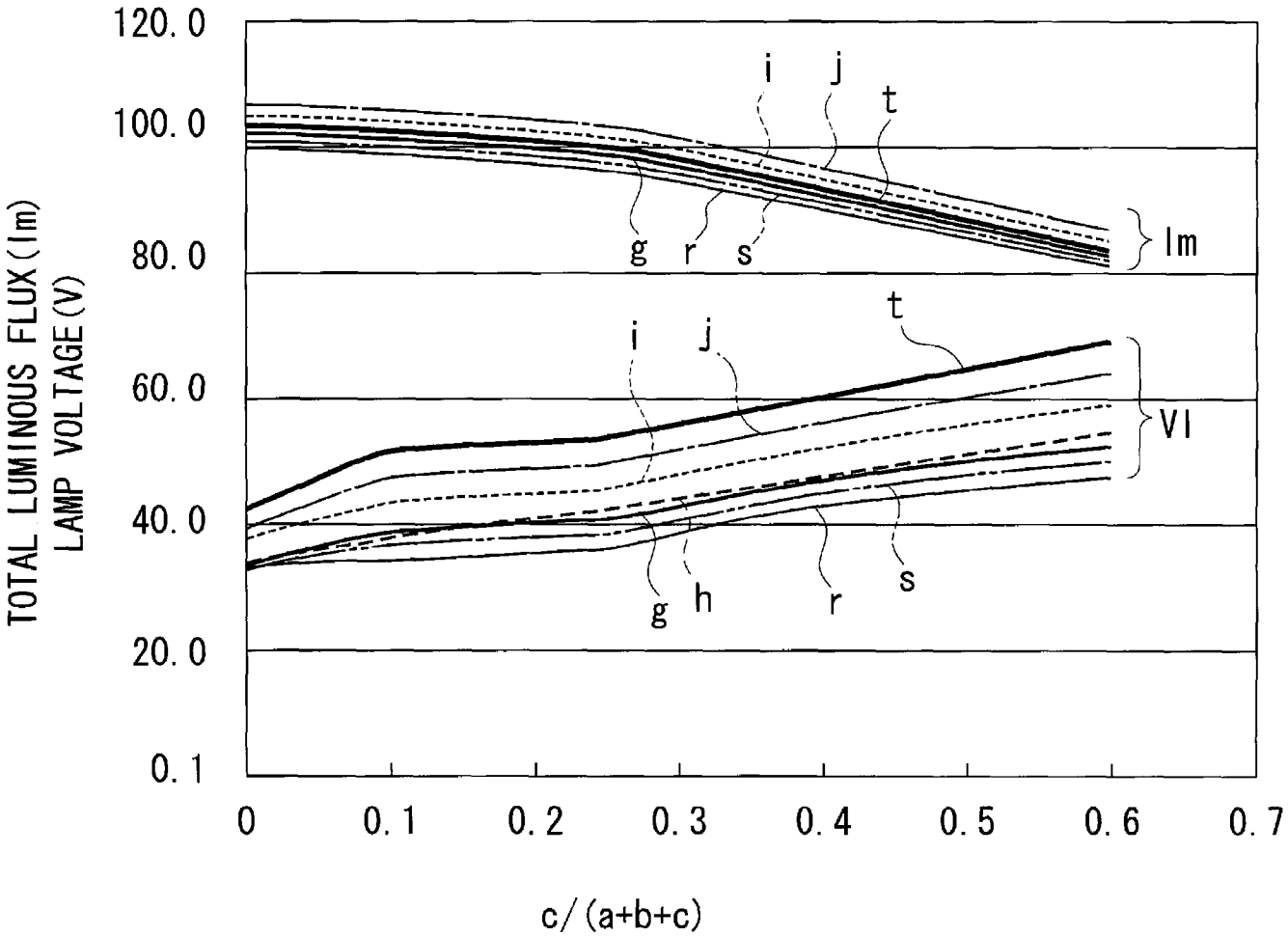
FIG. 5 is a graph showing relations between the ratio of the second halide to the sum of the first and second halides and the lamp voltage and total luminous flux, where the ratio of scandium halide to the sum of scandium halide and sodium halide is used as a parameter.

FIG. 5 is a graph showing relations between the ratio of the second halide to the sum of the first and second halides and the lamp voltage and total luminous flux, where the ratio of scandium halide to the sum of scandium halide and sodium halide is used as a parameter. In this drawing, the same reference characters as in FIG. 4 have the same means as in FIG. 4. The group of curves Vl indicates the lamp voltage, and the group of curves lm indicates the total luminous flux. The plural curves in each group are different from each other in parameter a/(a+b). That is, a/(a+b)=0.25 for a curve g, a/(a+b)=0.33 for a curve h, a/(a+b)=0.4 for a curve i, a/(a+b)=0.5 for a curve j, a/(a+b)=0.09 for a curve r, a/(a+b)=0.17 for a curve s, and a/(a+b)=0.60 for a curve t.

As can be seen from this drawing, a higher ratio of scandium halide provides a higher lamp voltage and a slightly higher total luminous flux.

Figure 6:
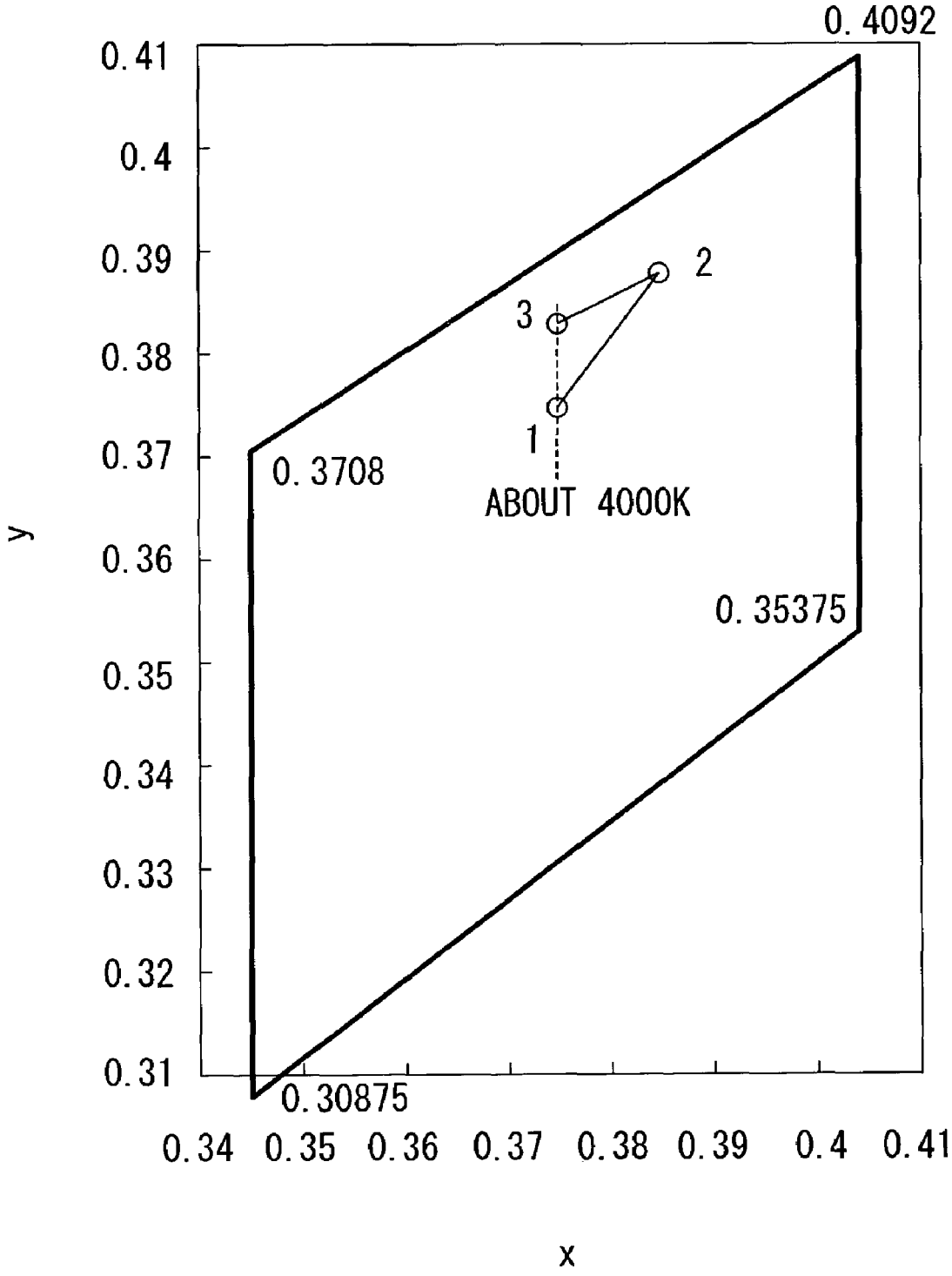
FIG. 6 is a chromaticity diagram showing a chromaticity for an example of the metal halide lamp according to the first embodiment of the invention along with chromaticities for comparison examples 1 and 2.

FIG. 6 is a chromaticity diagram showing a chromaticity for the example of the metal halide lamp according to the first embodiment of the invention along with chromaticities for comparison examples 1 and 2. In this drawing, reference numeral 1 denotes the comparison example 1, reference numeral 2 denotes the comparison example 2, and reference numeral 3 denotes the example. In addition, in this drawing, the dotted line indicates a color temperature of about 4000 K. Specifications of the comparison examples 1 and 2 are as follows.

Comparison Example 1

The discharge medium contained metal halides including 0.08 mg of $ScI_3$, 0.42 mg of NaI and 0.30 mg of $ZnI_2$ in relations of $ScI_3/(ScI_3+NaI)=0.16$ and $ZnI_2/(ScI_3+NaI+ZnI_2)=0.375$ and a xenon gas at 10 atmospheres at a temperature of 25° C.

The others are the same as those in the example.

The comparison example 1 differs from the example in that the amount of the second halide sealed is not reduced.

Comparison Example 2

The discharge medium contained metal halides including 0.1 mg of $ScI_3$, 0.5 mg of NaI and 0.2 mg of $ZnI_2$ in relations of $ScI_3/(ScI_3+NaI)=0.167$ and $ZnI_2/(ScI_3+NaI+ZnI_2)=0.25$ and a xenon gas at 10 atmospheres at a temperature of 25° C.

The others are the same as those in the example.

The comparison example 2 is the same as the example in that the amount of the second halide sealed is reduced, while the comparison example 2 differs from the example in that the ratio of scandium halide to the first halide is the same as that in the comparison example 1.

As can be seen from FIG. 6, if the amount of the second halide is only reduced, the color temperature varies. Thus, it is proved that the second halide has an action of adjusting color temperature. However, in the example, the amount of the second halide is reduced while keeping in balance the ratio between scandium halide and sodium halide, which are the first halides, or between the first and second halides, and thus, the color temperature can be kept constant and the chrominance can be kept falling within an allowable range.

Figure 7:
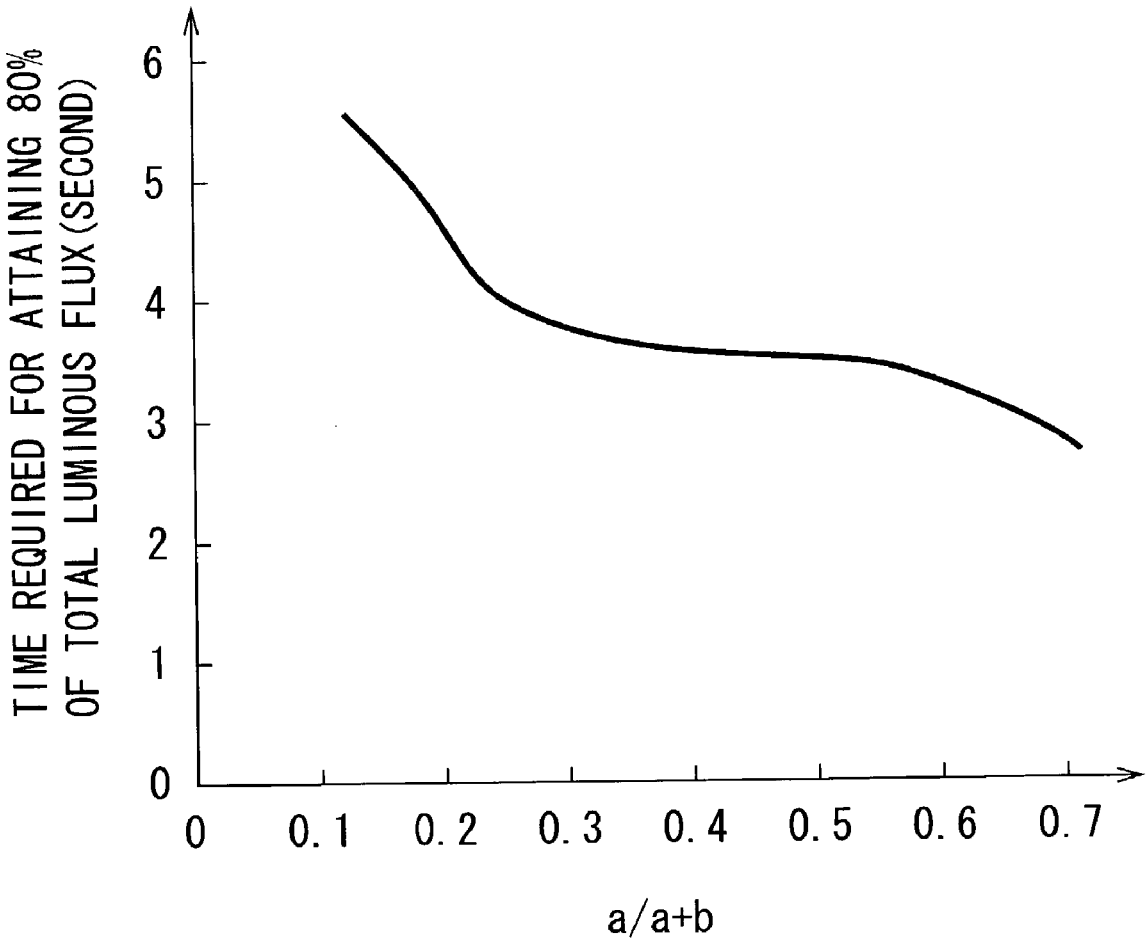
FIG. 7 is a graph showing an effect of a variation of a ratio a/(a+b) on rising characteristics of luminous flux in the example of the metal halide lamp according to the first embodiment of the invention.

FIG. 7 is a graph showing an effect of a variation of the ratio a/(a+b) on the rising characteristics of the luminous flux in the example of the metal halide lamp according to the first embodiment of the invention. In this drawing, the horizontal axis indicates the ratio a/(a+b), and the vertical axis indicates the time (seconds) required for 80% of the total luminous flux to be attained. The measurement was conducted in such a manner that a lamp power of 85 W, which approximately equals to 2.5 times a lamp power of 35 W in a stable state, was supplied immediately after activation of the metal halide lamp.

As can be seen from this drawing, within the range of $0.25<a/(a+b)<0.5$, 80% of the total luminous flux can be attained within 4 seconds after lighting.

Figure 8:
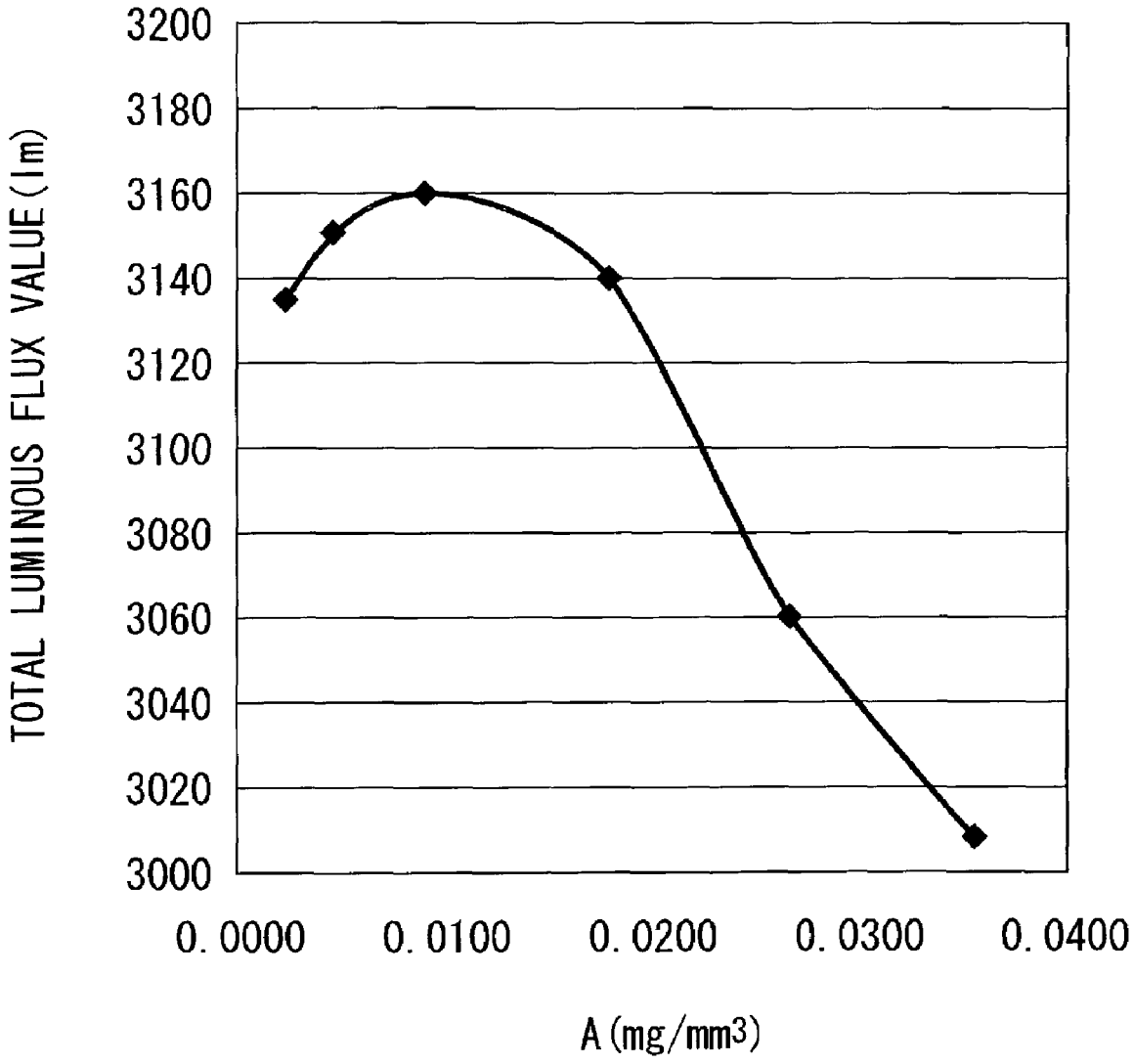
FIG. 8 is a graph showing a variation of the total luminous flux due to a change of the sum of the first and second halides in the example of the metal halide lamp according to the first embodiment of the invention.

FIG. 8 is a graph showing a variation of the total luminous flux due to a change of the sum of the first and second halides in the example of the metal halide lamp according to the first embodiment of the invention. In this drawing, the horizontal axis indicates the amount A ($mg/mm^3$) of the first and second halides per unit volume of the hermetic vessel, and the vertical axis indicates the total luminous flux (lm).

As can be seen from this drawing, within a range of $0.005<A<0.03$, a total luminous flux of 3040 lm or higher can be attained. Furthermore, within a preferred range of $0.005<A<0.02$, a total luminous flux of 3100 lm or higher can be attained.

Figure 9:
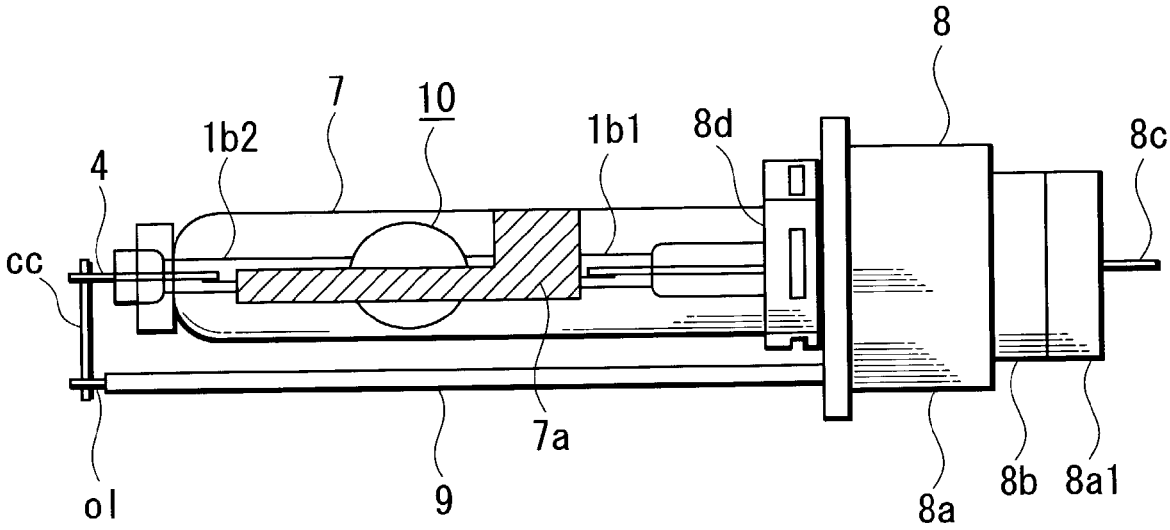
FIG. 9 is a front view of a metal halide lamp, which is a high voltage discharge lamp according to a second embodiment of the invention.

FIG. 9 is a front view of a metal halide lamp, which is a high voltage discharge lamp according to a second embodiment of the invention. According to this embodiment, the metal halide lamp as shown in FIG. 1 is adapted to be installed in an automotive headlamp. In this drawing, reference numeral 7 denotes an outer envelope, reference numeral 8 denotes a cap, reference character ol denotes an external lead, reference character cc denotes a connection conductor, reference numeral 9 denotes an insulating tube, and reference numeral 10 denotes an arc tube.

The outer envelope 7 has a capability of blocking ultraviolet rays and houses the arc tube 10 having the structure shown in FIG. 1. Both ends of the outer envelope 7 are glass-welded to sealing parts 1*b*1 and 1*b*2, while the end thereof located nearer the tip is designed to allow ventilation. A light-shielding film 7*a* is formed at a desired area of the outer surface of the outer envelope 7. The light-shielding film 7*a* is formed by melting a mixture of a pigment and frit glass by heating and applying the same to the outer envelope 7, which is effective for providing desired light distribution characteristics. Furthermore, the sealing part 1*b*1 and a base part of the outer envelope 7 are supported on the cap 8 by a fastener 8*d* described later, with the sealing part and the base part being fitted into the cap 8.

The cap 8 comprises a pair of power receiving terminals 8*b*, 8*c* incorporated with an insulating cap base 8*a* and the fastener 8*d*. The power receiving terminal 8*b* has the shape of a ring and is mounted on a small-diameter part 8*a*1 of the cap base 8*a* so as to be flush therewith. The power receiving terminal 8*c* protrudes toward the rear from the base end of the cap base 8*a*.

The external lead ol extends from the cap base 8*a* substantially in parallel with the outer envelope 7 and has a base end connected to the power receiving terminal 8*b* and a tip end welded to the connection conductor cc described later.

The connection conductor cc is interposed between the tip end of the external lead ol and the externally introduced line 4 located at the tip end of the arc tube 10 and interconnects the external lead ol and the externally introduced line 4.

The insulating tube 9 covers the external lead ol.

Figure 10:
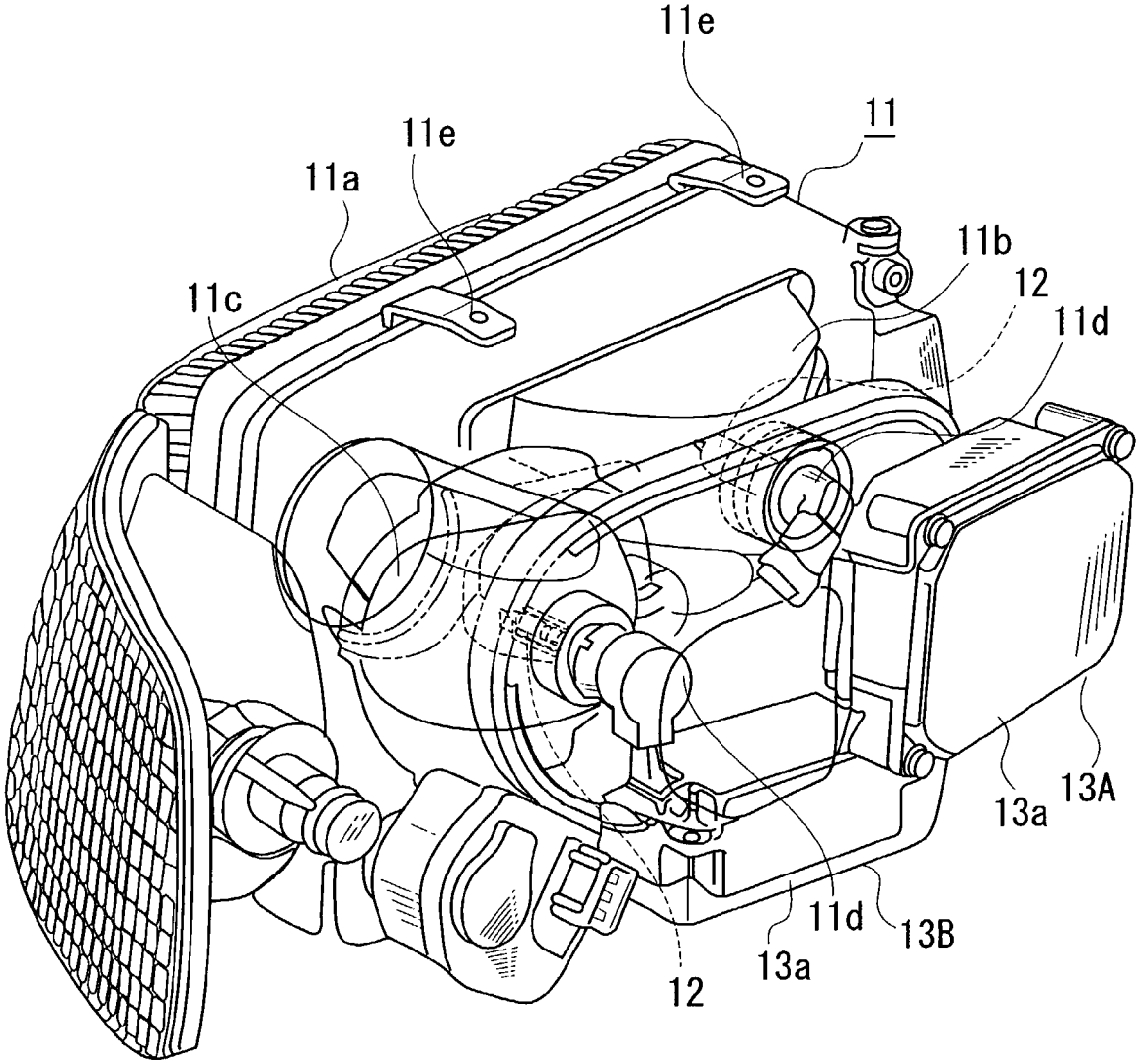
FIG. 10 is a perspective view of an automotive headlamp apparatus according to an embodiment of the invention viewed from the rear side thereof.

FIG. 10 is a perspective view of an automotive headlamp apparatus according to an embodiment of the invention viewed from the rear side thereof. In this drawing, reference numeral 11 denotes an automotive headlamp apparatus main unit, reference numeral 12 denotes a metal halide lamp, and reference numeral 13 denotes a lighting device.

The automotive headlamp apparatus main unit 11 comprises a front transparent panel 11*a*, reflectors 11*b*, 11*c*, a lamp socket 11*d* and a fixture 11*e*. The front transparent panel 11*a* is contoured to the shape of the surface of the automobile and has desired optical means, for example, a prism. Each of the reflectors 11*b*, 11*c* is provided for each metal halide lamp 12 and configured to provide required light distribution characteristics. The lamp socket 11*d* disconnected to an output terminal of the lighting device 13 and is mounted in a cap 12*d* of the metal halide lamp 12. The fixture 11*e* is means for fixing the automotive headlamp apparatus main body 11 to the automobile at a predetermined position.

The metal halide lamp 12 has the construction shown in FIGS. 1 and 6. The lamp socket 11*d* is mounted in the cap and connected thereto. In this way, the two-bulb metal halide lamp 12 is mounted in the automotive headlamp apparatus main unit 11, and the four-bulb automotive headlamp apparatus is constructed. The light emitting parts of each metal halide lamp 12 are located generally at focal points of the reflectors 11*b*, 11*c* of the automotive headlamp apparatus main unit 11.

Lighting devices 13A, 13B are housed in metallic vessels 13*a* and energize the metal halide lamp 12 to turn on it.

The invention claimed is:

1. A metal halide lamp comprising:

a hermetic vessel which is fire resistant and translucent;

a pair of electrodes sealed in the hermetic vessel facing each other at a distance of 5 mm or less; and a discharge medium substantially containing no mercury, sealed in the hermetic vessel, and containing first halides mainly including scandium halide and sodium halide, a second halide for mainly providing a lamp voltage, the second halide emitting substantially no visible light, and a xenon gas at 5 atmospheres or higher at a temperature of 25° C., the amounts of scandium halide and sodium halide sealed in the hermetic vessel satisfying the formula:

$$0.27<a/(a+b)<0.37$$

where reference character a denotes the mass of scandium halide and reference character b denotes the mass of sodium halide, in a stable state, the metal halide lamp is turned on with a lamp power of 60 W or lower; and wherein the second halide comprises one or more halides of metals selected from among Mg, Co, Cr, Zn, Mn, Sb, Re, Fe, Al, Ti, Zr, and Hf.

2. The metal halide lamp according to claim 1, wherein the first halide contains metal halides including at least ScI3, NaI and InBr and/or InI, and the mass ratio of the InBr and/or InI to the sum of scandium halide and sodium halide is one-fifth or less.

3. The metal halide lamp according to claim 1, wherein the amounts of scandium halide, sodium halide and the second halide sealed in the hermetic vessel satisfy the formula:

$$0.1<c/(a+b+c)<0.4,$$

where reference character a denotes the mass of scandium halide, reference character b denotes the mass of sodium halide and reference character c denotes the mass of the second halide.

4. The metal halide lamp according to claim 1, wherein the discharge medium contains the first and second halides in an amount of 0.005 mg/mm$^3$ or more of an inner volume of the hermetic vessel.

5. The metal halide lamp according to claim 1, wherein the discharge medium contains the first and second halides in an amount of A mg/mm$^3$ of an inner volume of the hermetic vessel, and the formula is satisfied:

$$0.005<A<0.03.$$

6. The metal halide lamp according to claim 1, wherein the inner volume of the hermetic vessel is 0.01 cc or less.

7. The metal halide lamp according to claim 1, wherein the paired electrodes are at a distance of 4.2 mm ±0.6 mm.

8. The metal halide lamp according to claim 1, wherein the xenon gas in the discharge medium is at 5 to 20 atmospheres at 25° C.

9. The metal halide lamp according to claim 1, wherein the xenon gas in the discharge medium is at 8 to 16 atmospheres at 25° C.

10. The metal halide lamp according to claim 1, wherein the lamp power is 35 W±3 W.

11. An automotive headlamp apparatus comprising:

an automotive headlamp apparatus main unit;

a metal halide lamp according to claim 1 installed in the automotive headlamp apparatus main unit; and a lighting device for turning on the metal halide lamp.

* * * * *